United States Patent [19]

Kistrup et al.

[11] Patent Number: 4,835,015

[45] Date of Patent: May 30, 1989

[54] PROCESS FOR ELECTROLESS METALLIZATION OF SHEETLIKE TEXTILE SUBSTRATES

[75] Inventors: Holger Kistrup, Esslingen; Gábor Bènczûr-Ürmössy, Stuttgart; Friedrich Haschka, Esslingen, all of Fed. Rep. of Germany

[73] Assignee: Deutsche Automobilgesellschaft mbH, Hanover, Fed. Rep. of Germany

[21] Appl. No.: 175,283

[22] Filed: Mar. 30, 1988

[30] Foreign Application Priority Data

Apr. 1, 1987 [DE] Fed. Rep. of Germany ..... 3710895

[51] Int. Cl.[4] ..... C23C 18/16

[52] U.S. Cl. ..... 427/306; 427/443.1

[58] Field of Search ..... 427/306, 443.1

[56] References Cited

U.S. PATENT DOCUMENTS 2,509,304 5/1950 Klein .
2,569,578 10/1951 Rieger .
3,975,242 8/1976 Matsuda et al. .

FOREIGN PATENT DOCUMENTS 0032530 7/1981 European Pat. Off. .
1197720 7/1965 Fed. Rep. of Germany .
1804042 5/1970 Fed. Rep. of Germany ..... 421/306
2250309 10/1971 Fed. Rep. of Germany ..... 421/306
2743768 3/1980 Fed. Rep. of Germany .
3625475 2/1988 Fed. Rep. of Germany .
1083102 9/1967 United Kingdom .
1454739 11/1976 United Kingdom .
1600567 10/1981 United Kingdom .

*Primary Examiner*—Sam Silverberg
*Attorney, Agent, or Firm*—Barnes & Thornburg

[57] ABSTRACT

The invention relates to a process for the chemical metallization of sheetlike textile substrates, in particular, of non-woven or needle felt webs, in which the substrates are activated and subsequently electrolessly metallized in a reductant-containing metallization solution in a horizontal attitude or at an angle of up to 20° with the horizontal. The hydrogen which appears as a by-product in the course of the metallization can, as a result, escape particularly simply and rapidly from the substrate, so that uniform metallization of the fibers of the substrate can take place across the entire thickness of the substrate.

6 Claims, 1 Drawing Sheet

PROCESS FOR ELECTROLESS METALLIZATION OF SHEETLIKE TEXTILE SUBSTRATES

BACKGROUND AND SUMMARY OF THE INVENTION

The invention relates to a process for electrolessly metallizing sheetlike textile substrates, in particular, non-woven or needle felt webs, in which the substrates are activated and subsequently electrolessly metallized in a reductant-containing metallizing solution.

The surfaces of the fibers of textile substrates, in particular, those made of plastics fibers, are known to be non-electroconductive, and therefore cannot of themselves initiate a chemical metal deposition. To prepare the electroless (chemical) metallization, the fiber surfaces are therefore activated in a first step by nucleation with a catalytically active substance. Activation is possible not only with ionic and/or colloidal, but also with organic adducts of the elements of subgroups I and VIII of the periodic table of the elements. The elements generally used are gold, silver, palladium, platinum and copper. A particularly preferred activating metal is palladium in the form of a sol, in the form of an organometallic compound, or in particular, in the form of aqueous solutions which contain salts of palladium and tin.

After the substrate has been impregnated with the activating solution, the excess activating solution is removed, and the substrate is, if desired, treated with an accelerating solution and possibly rinsed, and thereafter dipped into a customary metallizing bath, such as those based on copper, silver, and in particular, nickel being preferred.

The preparation and the composition of activating solutions are familiar to those skilled in the art and described, for example, in German Published Application DE-AS No. 1,197,720, or German Laid-Open Application DE-OS No. 2,743,768. Similarly, a wide variety of metallizing solutions are known to those skilled in the art. Aside from complexing agents and agents for setting the pH, they contain mainly a dissolved salt of the metal to be deposited and a reductant. The reductants used are customarily sodium hypophosphite or sodium borohydride, but can also include alkylaminoboranes or formalin.

The chemical deposition of metal starts in those areas where the metallizing solution comes into contact with the catalytically active nuclei present on the fiber surface. However, hydrogen evolution generally also takes place in competition with the chemical deposition of metal. It is thus necessary not only to ensure an adequate supply of the metal ions to be reduced, together with the reductant, to the fiber surface, but also to guarantee the removal of the gaseous hydrogen formed in the course of the competing reactions by the catalyst particles adhering to the fiber.

It is true that the chemical deposition of metal on individual fibers is perfectly unproblematic. However, difficulties result in general when the totality of the fibers which make up a textile substrate, in particular a non-woven or needle felt, are to be metallized. The porosity of non-wovens or needle felts is customarily between 40 and 97%. If the fibers are very thin, for example, 1 to 4 dtex, and the fiber surfaces to be metallized become correspondingly large, the transport of the hydrogen bubbles out of the interior of the textile substrate can be impaired or slowed down. As a consequence, the accumulated hydrogen bubbles tend to block the access of further metals ions and ions of the reductant to the fiber surface. In these areas, metallization is then insufficient.

In known methods, the removal of the resulting hydrogen is facilitated in a chemical metallization of plastics fiber surfaces of a non-woven or of a needle felt by winding a previously activated non-woven or needle felt web of a certain length and width in spiral form onto a runner, in such a way as to include a layer of porous corrugated separator between pairs of layers of the non-woven or needle felt web. The runner thus produced is provided with an outer collar for shape stabilization, and is subsequently dipped perpendicularly into the metallizing solution. During the process of metallization, the hydrogen, which evolves at a very lively rate, can exit out of the interior of the substrate into the channels of the corrugated separator and rise upwards therein and escape from the metallization vessel. Nonetheless, the hydrogen formed does not escape quickly enough through the channels of the corrugated separator or does not leave the interior of the non-woven or needle felt to a complete enough extent.

Further, the addition of additives, such as wetting agents, to the metallizing solution or variation of the rate of metallization through temperature change in the solution did not bring about complete elimination of excessively non-uniform hydrogen evolution and/or removal. As a direct consequence thereof, the chemical metallizations in the individual zones in the interior of the textile substrates, in particular on non-wovens or needle felts, are excessively non-uniform as well, such that the fiber surfaces in individual zones in the interior of the textile substrate are not covered with a continuous metal coat. In these areas, the fiber surfaces then do not have the desired metallic properties such as, for example, thermoconductivity, electroconductivity, magnetic action, screening functions, electroplatability and the like.

An object of the present invention is to provide a process for the electroless metallization of sheetlike textile substrate, in particular non-wovens or needle felts, in which an adequate coating with a chemically deposited metal is obtained on the totality of the fiber surfaces of the textile substrate without individual zones or fibers of the non-woven or needle felt being metallized incompletely or non-uniformly or non-continuously.

This object is achieved by providing a process including activating a sheetlike textile substrate, and then metallizing the activated sheetlike substrate by holding the substrate in a single-ply form or multi-ply form in a metallizing solution in a horizontal attitude or at an angle of up to 20° with the horizontal.

As a result, the hydrogen can escape upwards along a very short path, namely, only the thickness of the single- or multi-ply textile substrate, and the accumulation of relatively large gas cushions in the interior of the substrate, i.e., the non-woven or needle felt web, is avoided.

If a plurality of superposed substrates are metallized simultaneously, it is further advantageously contemplated in certain preferred embodiments to facilitate gas removal by holding the substrates in the solution spaced from each other. In certain preferred embodiments, it is contemplated to provide this spacing by the interposition of corrugated perforated separators or of wire networks between the substrates.

The angle by which the substrates deviate from the horizontal should not be greater than 20°. If the substrates are at too steep an angle in the solution, it is possible for gas cushions to accumulate in relatively large areas of the textile material.

It is contemplated to improve the uniformity of metallization in a conventional manner by agitating the metallizing solution, for example by means of circulation pumps, or by periodically rocking or tilting the entire metallizing vessel. Since the textile substrates, in particular, non-woven or needle felt webs, can float to the surface of the metallizing solution as a result of gas evolution, it is contemplated to hold the substrates in the solution. This is achieved most simply by holding down the substrates beneath the surface of the liquid by a grid which can be locked in place in the metallizing vessel or which, on account of its weight, exerts a downward pressure on the substrate. A further possibility contemplated includes fixing the textile substrate in a rigid frame and holding it in the solution by means of this frame.

After the metallization has ended, the substrates are removed from the solution and converted into the end products in a conventional manner, for example, by washing, drying and confectioning.

The process is suitable for metallizing all fiber materials which can also be metallized using the existing processes. Examples of these fibers include non-wovens or needle felts made of polyethylene, polypropylene, polyamide, polyacrylonitrile, nylon, aramid and the like. The process is particularly effective in the case of non-wovens or needle felts which have a porosity between 40 and 97%. It is in the metallization of such materials that the process offers the greatest advantages.

Other objects, advantages and novel features of the present invention will become apparent from the following detailed description of the invention when considered in conjunction with the accompanying drawings.

DETAILED DESCRIPTION OF THE DRAWINGS

Figure 1:
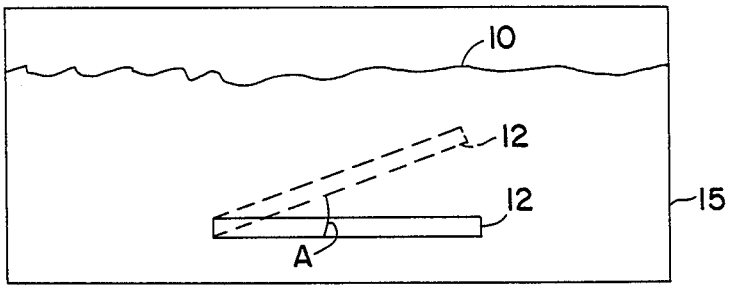
FIG. 1 is a schematic side view of a sheetlike substrate being held in a metallizing solution according to certain preferred embodiments of the invention.

As shown in FIG. 1, a sheetlike textile substrate 12 is held in a metallizing solution 10 in a horizontal attitude. As shown by broken lines, the sheetlike metal substrate 12 can be held in the metallizing solution 10 up to an angle A of 20° with the horizontal.

Figure 2:
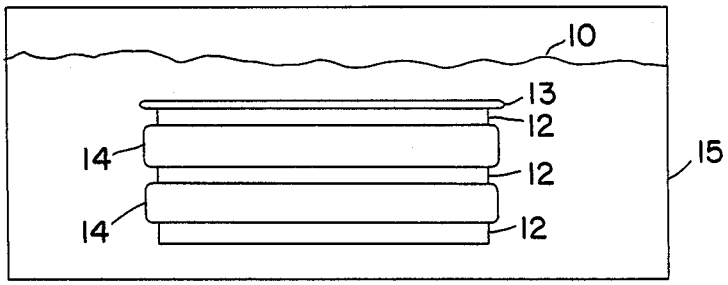
FIG. 2 is a schematic side view according to certain preferred embodiments of the invention in which a plurality of superposed sheetlike substrates are disposed in a metallizing solution.

As shown in FIG. 2, a plurality of sheetlike textile substrates 12 are held spaced from one another in a metallizing solution 10. In the shown embodiment, the sheetlike textile substrates 12 are spaced from one another by the interposition of separating elements 14 between the substrates 12. In certain preferred embodiments, these separating elements can be corrugated, perforated separators or wire networks.

Also shown in FIG. 1 is an element 13 used for holding the sheetlike textile substrates 12 beneath the surface of the metallizing solution 10. Examples of suitable contemplated holding elements 13 include a grid which can be locked in place in a metallizing vessel 15 or a grid which exerts a downward pressure on the sheetlike metal substrate 12 on account of its own weight. Another contemplated embodiment includes fixing the textile substrate 12 in a rigid frame and holding the substrate in the solution by this frame. It is contemplated to use the holding elements 13 for embodiments metallizing a single substrate 12 or a plurality of substrates 12.

The following examples are offered by way of illustration only and should not be construed as limiting the scope of the present invention in any way.

EXAMPLE 1

A non-woven web which was composed of polyethylene and had a porosity of 84%, a length of 10 m, a width of 70 cm, and a thickness of 5 mm, and which had been activated with a commercial activating solution based on palladium/tin was placed horizontally in triple ply (3×3.33 mm) into a steel tank. The non-woven web was then covered from above with a metal grid which could be locked in place, and then covered with 40 liters of metallizing solution containing per liter 40 g of nickel chloride, 62.5 g of sodium hypophosphite, 125 g of ammonium chloride and 39 g of sodium hydroxide, as well as water. This nickelization of the non-woven web began after about 2 minutes. The hydrogen escaped upwards through the non-woven plies transversely to the thickness of the plies. Thus, the hydrogen formed no longer escaped via vertically arranged channels of a corrugated separator or the like, but only through the pores of the horizontally superposed non-woven plies. After the nickelization had ended, the non-woven web was analyzed, and it was found that all the fibers of the non-woven web had been satisfactorily nickelized and indeed were electroplatible.

EXAMPLE 2

A needle felt web which was composed of polypropylene and had a porosity of 93%, a length of 5 m, a width of 40 cm, and a thickness of 2 mm, and which had been activated with a commercial activating solution based on palladium/tin, was chemically coppered. For this end, the web was forced by means of a metal grid horizontally beneath the surface of a coppering solution containing 300 g of copper sulphate, 300 g of Rochelle salt, 120 g of sodium hydroxide and 500 g of formaldehyde, as well as 6 liters of water. Hydrogen evolution started soon, and after about one hour, all the fibers of the needle felt had been coppered. A microscope revealed that even in the interior of the needle felt, all the fibers had been uniformly metallized.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Process for electrolessly metallizing sheetlike textile substrates, comprising:

activating at least one sheetlike textile substrate in activating solution, said sheetlike textile substrate having the greatest surface area on opposing planar surfaces; and metallizing the at least one activated sheetlike textile substrate by holding the at least one sheetlike textile substrate in one of a single-ply form and a multi-ply form in a reductant-containing metallizing solution, such that the planar surfaces are in a metallizing position ranging from a horizontal plane to an angle of 20° with the horizontal plane.

2. Process as in claim 1, further including simultaneously metallizing a plurality of activated sheetlike textile substrates in a layered arrangement such that the activated sheetlike textile substrates are held spaced from one another in the metallizing position.

3. Process as in claim 2, wherein said simultaneous metallizing of a plurality of activated sheetlike textile substrates includes interposing spacing means between adjacent layers of activated sheetlike textile substrates.

4. Process as in claim 3, wherein said interposing of spacing means includes using spacing means comprising at least one of corrugated, perforated separators and wire networks.

5. Process as in claim 1, wherein said metallizing includes using holding means for holding said at least one activated sheetlike textile substrate under a surface of said metallizing solution, said holding means comprising at least one of a locked grid placed over said substrate, a weighted grid placed over said substrate and a frame fixed around said substrate.

6. Process as in claim 1, wherein the sheetlike textile substrate comprises non-woven and needle felt webs.

* * * * *